US006874203B2

(12) United States Patent
Bauersachs

(10) Patent No.: US 6,874,203 B2
(45) Date of Patent: Apr. 5, 2005

(54) SAW-TOOTH WIRE FOR A SET OF ROLLERS

(75) Inventor: Axel Bauersachs, Althengstett (DE)

(73) Assignee: Trützschler Card Clothing GmbH, Neubulach (DE)

( * ) Notice: Subject to any disclaimer, the term of this patent is extended or adjusted under 35 U.S.C. 154(b) by 0 days.

(21) Appl. No.: 10/472,625

(22) PCT Filed: Mar. 8, 2002

(86) PCT No.: PCT/EP02/02576

§ 371 (c)(1),
(2), (4) Date: Mar. 26, 2004

(87) PCT Pub. No.: WO02/077338

PCT Pub. Date: Oct. 3, 2002

(65) Prior Publication Data

US 2004/0154137 A1 Aug. 12, 2004

(30) Foreign Application Priority Data

Mar. 22, 2001 (EP) ..... 10114108

(51) Int. Cl.[7] ..... D01G 15/84
(52) U.S. Cl. ..... 19/114
(58) Field of Search ..... 19/98, 99, 102, 19/103, 104, 105, 106 R, 110, 111, 112, 113, 114, 115 R; 29/34 D; 76/101.1, 112; 83/846; 140/97; 57/408

(56) References Cited

U.S. PATENT DOCUMENTS

| | | | | | |
|---|---|---|---|---|---|
| 795,946 | A | | 8/1905 | Thielmann | |
| 2,937,413 | A | * | 5/1960 | Hollingsworth | 19/114 |
| 4,653,152 | A | | 3/1987 | Wada | |
| 4,854,012 | A | * | 8/1989 | Graf | 19/114 |
| 4,953,264 | A | * | 9/1990 | Hollingsworth et al. | 19/114 |
| 4,964,195 | A | * | 10/1990 | Hollingsworth | 19/114 |
| 5,581,848 | A | * | 12/1996 | Egerer | 19/114 |
| 6,035,493 | A | | 3/2000 | Carlton | |
| 6,408,487 | B1 | * | 6/2002 | Atkinson | 19/114 |
| 6,523,226 | B2 | * | 2/2003 | Graf | 19/114 |

FOREIGN PATENT DOCUMENTS

EP 0 322 474 A 7/1989

OTHER PUBLICATIONS

International Search Report.
International Preliminary Examination Report—English.
German Patent Office Action.

* cited by examiner

*Primary Examiner*—Gary L. Welch
(74) *Attorney, Agent, or Firm*—Venable LLP; Catherine M. Voorhees

(57) ABSTRACT

The present invention relates to a sawtooth wire for a cylinder lining, in particular for a doffer cylinder for a carding machine. In order to improve the take-over and delivery properties of the doffer cylinder to a subsequent stuffer cylinder, the sawtooth wire is implemented such that the back angle of the tooth angle of the individual teeth increases from the base to the tip of the respective tooth. Owing to this tooth design, it can be achieved that the tooth back is steep in the area of the tip of the tooth, whereby the delivery properties of the doffer cylinder to the subsequent stuffer cylinder will be improved, while the breast angle is large; this will facilitate the take-over of fibres from the main cylinder that rotates at a higher speed.

5 Claims, 2 Drawing Sheets

SAW-TOOTH WIRE FOR A SET OF ROLLERS

Figure 1:
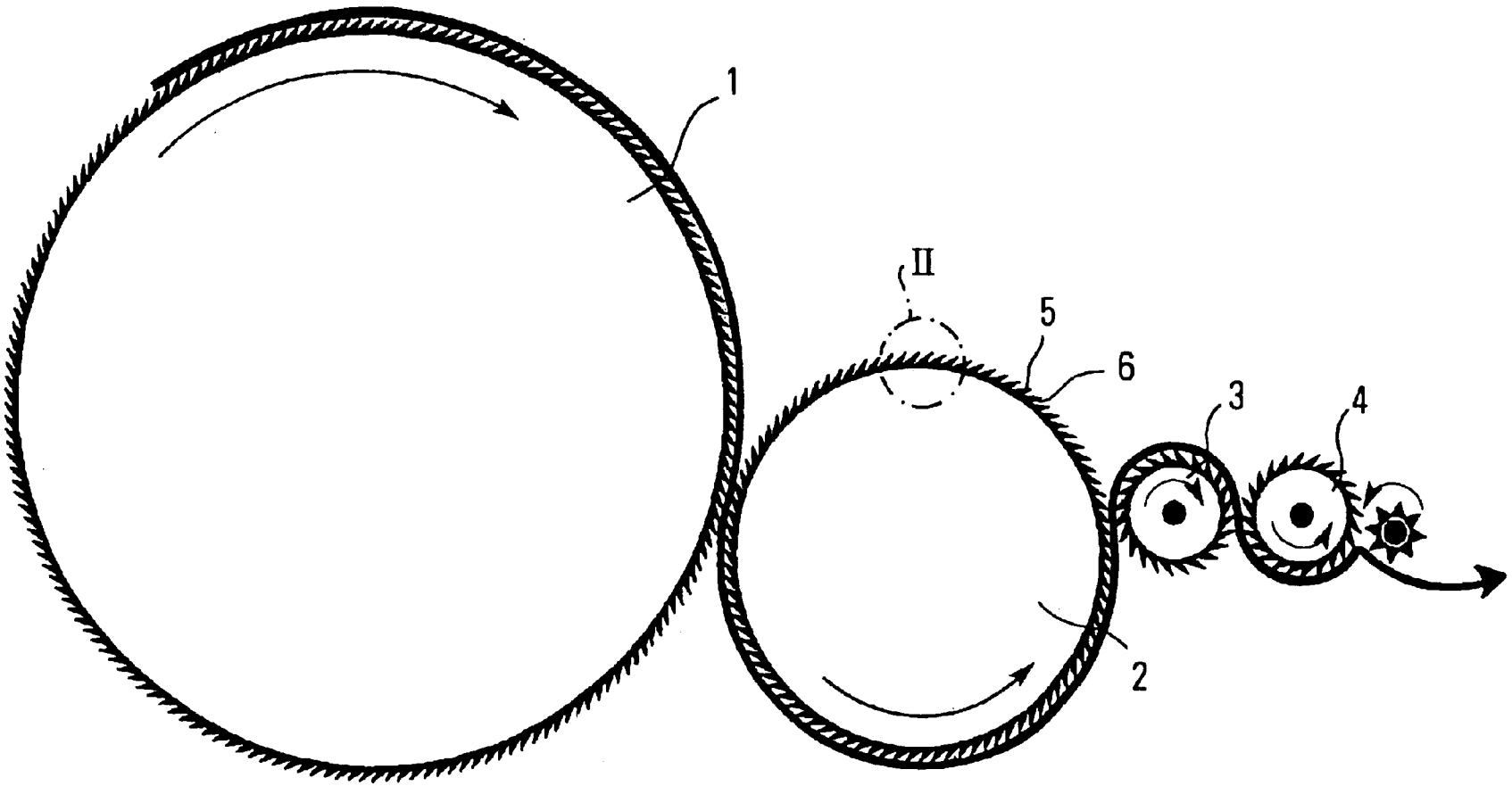

The present invention relates to a sawtooth wire for a cylinder lining of a fibre-processing machine, in particular a carding machine, comprising a tooth base extending in the longitudinal direction of the sawtooth wire and a plurality of teeth arranged one behind the other in the longitudinal direction of said sawtooth wire, each of said teeth having a tooth breast inclined forward at an angle (breast angle (BW)) and a tooth back inclined at an angle (back angle (RW)) relative to the longitudinal direction of said sawtooth wire, the imaginary extensions of the tooth breast and the tooth back intersecting and forming thus a tooth tip.

Such sawtooth wires are used for linings of carding machines and the like. For this purpose, the sawtooth wires are wound onto the cylinder side by side and form a so-called sawtooth wire lining in the case of which the teeth are all oriented in one direction. Depending on the type of cylinder, e.g. the main cylinder, the tooth breast is the leading part of the tooth. In the case of other cylinders, such as e.g. the doffer cylinder, the tooth back is the leading part of the tooth. Transfer from the fast-rotating main cylinder to the slow-rotating doffer cylinder is effected in that the fibres are pushed into the sawtooth wire lining of the doffer cylinder from the main cylinder. If the doffer cylinder is followed by a stuffer cylinder, transfer of the fibres from the doffer cylinder to the first stuffer cylinder takes place in the same way as from the main cylinder to the doffer cylinder, but the fibres are then transferred to the stuffer cylinder by the tooth back of the teeth of the sawtooth wire lining of the doffer cylinder.

It is the object of the present invention to provide a sawtooth wire by means of which transfer of the fibres will be improved, in particular for doffer cylinders and also stuffer cylinders in the case of which the fibres are transferred via the tooth back to a cylinder rotating at a lower speed.

The present invention achieves this object by the features of the generic clause of claim 1 in combination with the feature that the inclination angle (back angle (RW)) of the tooth back increases from the tooth base to the tooth tip.

In the case of known sawtooth wires, the tooth back as well as the tooth breast are implemented in a straight line, i.e. the tooth back and the tooth breast extend, in a convergent manner, from the tooth base in a straight line and meet at the tooth tip. This has inevitably the consequence that in the case of a large breast angle, i.e. strongly inclined teeth, the back will have a small angle of inclination, i.e. a complementary small back angle will be formed. The large breast angle of a doffer cylinder is desired, since, during transfer of the fibres, the cylinder taking over the fibres will then be able to take them up more effectively. The solution according to the present invention permits the realization of a large breast angle, so that the fibres can be taken over more easily, in combination with a large back angle, so that the fibres can be delivered more easily to the subsequent stuffer cylinder that rotates at a lower speed.

The solution according to the present invention can be realized in a particularly simple manner when the tooth back has at least one bend. The tooth back from the tooth base to the bend can then have a back angle corresponding to that of a conventional sawtooth. From the bend to the tip, the back angle is, however, larger so that this upper part of the tooth back does not meet the tooth breast at the tip of the tooth. It proved to be advantageous when the bend is located on a level corresponding to at least approx. ⅔ of the tooth height.

The range of approx. ⅔ of the tooth height can, however, be a preferred range. In this way, a sufficiently high stability of the tooth is achieved in combination with an improved functionality during transfer of the fibres to the next cylinder. The increase in the inclination angle (from RW1 to RW2) can be at least 10%.

The ratio of the two inclination angles is approx. 3:2.

The present invention has a particularly advantageous effect in the case of sawtooth wires having an inclination angle of the tooth breast that is <40°, preferably <45°.

The inclination angle of the tooth back from the bend to the tooth tip is at least 36°, preferably at least 40°.

The present invention additionally relates to a cylinder, in particular a doffer cylinder or a stuffer cylinder, of a carding machine provided with a sawtooth wire lining according to the present invention.

Figure 2:
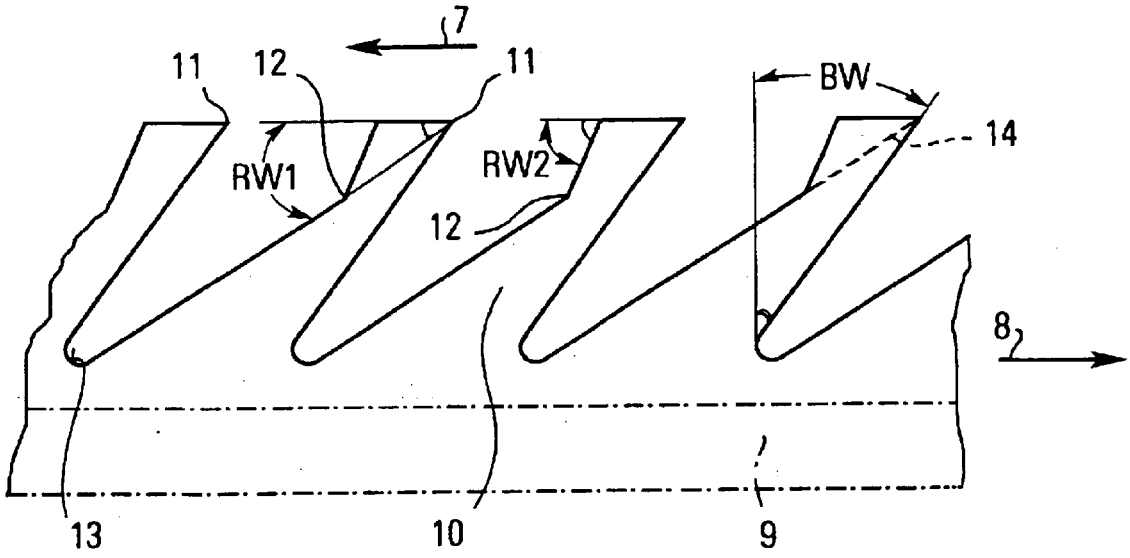

In the following, an embodiment of the present invention will be explained in detail on the basis of a drawing, in which:

FIG. 1 shows in a schematic representation a carding machine with depicted fibre flow and FIG. 2 shows in an enlarged representation a sawtooth portion according to detail II of FIG. 1.

FIG. 1 shows the main elements of a carding machine. These main elements are the main cylinder 1 which is normally operated at a circumferential speed of 800–1,500 m/min and which rotates clockwise, and the subsequent doffer cylinder 2 which rotates anticlockwise at a circumferential speed of normally 60–300 m/min. The doffer cylinder 2 is followed by a first stuffer cylinder 3 which rotates clockwise at a circumferential speed amounting normally to approx. 50–80% of the circumferential speed of the doffer cylinder 2. The first stuffer cylinder 3 is followed by a second stuffer cylinder 4 which rotates anticlockwise at a circumferential speed amounting to 60–90% of the circumferential speed of said first stuffer cylinder 3.

In the following, the tooth orientation of the individual cylinders will be explained in detail on the basis of the fibre flow shown in FIG. 1. The main cylinder 1 is provided with a sawtooth wire lining in the case of which the tooth breast faces the direction of rotation. The fibres are entrained by the tooth breast of the lining and transferred to the doffer cylinder 2. This doffer cylinder 2 is provided with a sawtooth wire lining in the case of which the tooth back 5 faces the direction of rotation, whereas the tooth breast 6 faces the tooth breast of the sawtooth wire lining of the main cylinder 1. The transfer of fibres between the main cylinder and the doffer cylinder 2 takes place in that the fibres are stuffed by means of the sawtooth wire lining of the main cylinder into the pockets formed by the tooth breast 6 of the sawtooth wire lining of the doffer cylinder which rotates at a lower circumferential speed. The transfer from the doffer cylinder 2 to the first stuffer cylinder 3 takes place in a similar way, said transfer to the first stuffer cylinder 3 being then, however, not effected by the tooth breast but by the tooth back of the sawtooth wire lining of the doffer cylinder. Transfer from the first to the second stuffer cylinder 4 is effected in the same way.

FIG. 2 shows exemplarily the sawtooth wire of the lining of the doffer cylinder 2 of FIG. 1. Also the lining of the first stuffer cylinder 3 can be implemented in the same way. The structural design of the sawtooth wire shown in FIG. 2 and described hereinbelow is suitable to be used for the linings of cylinders in the case of which the fibres are taken over from a faster-rotating cylinder and delivered to a slower-rotating cylinder. The direction of movement of the lining is indicated by arrow 7 in FIG. 2.

The sawtooth wire shown there has a sawtooth base 9 extending in the longitudinal direction 8 of the wire and a plurality of teeth 10 which are arranged one after the other in the longitudinal direction 8 of the sawtooth wire. Each of said teeth has a tooth breast 6 and a tooth back 5, the imaginary extensions of the tooth back 5 and of the associated tooth breast 6 intersecting at one point, viz. the tooth tip 11. The tooth breast 6 is inclined forward; it forms a pocket together with the neighbouring tooth back. The respective angles in the drawing are designated as follows: BW is the breast angle which is measured between the tooth breast 6 and an imaginary line perpendicular to the tooth base 9. RW stands for the back angle and is measured between the back 5 of a tooth and an imaginary horizontal line interconnecting the tips 11 of the individual teeth.

As can be seen from the figure, there is a bend 12 in the tooth back 5 of the teeth 10, said bend being located on a level corresponding to approximately ⅔ of the height of the respective teeth 10. The tooth back 5 extends from the lowermost point 13 up to the bend 12 in a straight line. The back angle of this portion of the tooth back is referred to as RW1 and amounts to 30° in the embodiment shown here. From the bend to the tooth tip and the imaginary line interconnecting the tooth tips 11, respectively, the associated back angle is referred to as RW2 and amounts to 70°. Due to this change in the back angle in the sense of an enlargement, the tooth shape substantially deviates from the hitherto customary tooth shape, which is indicated by the broken line 14 in the right tooth of FIG. 2. The tooth back 5 is much steeper in the upper area thereof. In the embodiment shown here, the breast angle amounts to 40°.

The tooth shape represented in FIG. 2 shows that the back angle in the upper area of the teeth 10 is independent of the breast angle BW. Hence, this tooth shape permits a large breast angle and a large back angle to be realized at the same time. The large breast angle facilitates the taking over of fibres from a faster-rotating cylinder, whereas the large back angle facilitates the delivery of fibres to a slower-rotating cylinder because the steeper rear profile will stuff the fibres better into the lining of the subsequent slower-rotating cylinder.

What is claimed is:

1. A sawtooth wire for a cylinder lining of a fibre-processing machine, in particular a carding machine, comprising: a tooth base extending in the longitudinal direction of the sawtooth wire and a plurality of teeth arranged one behind the other in the longitudinal direction of said sawtooth wire, each of said teeth having a tooth breast inclined forward at a breast angle and a tooth back inclined at a first back angle relative to the longitudinal direction of said sawtooth wire, and configured such that imaginary extensions of the tooth breast and the tooth back intersect and form a tooth tip, characterized in that the tooth back defines a second back angle and that the first back angle of the tooth back increases from the tooth base to the tooth tip in such a way that the first back angle in the area of the tooth base is smaller than said second back angle in the area of the tooth tip, the tooth back defining a bend positioned approximately ⅔ of the tooth height, and the breast angle of the tooth being less than 45°.

2. A sawtooth wire according to claim 1, characterized in that the increase in the angle from said first back angle to said second back angle is at least 10%.

3. A sawtooth wire according to claim 1, characterized in that the ratio of said first back angle to said second back angle is approximately 3:2.

4. A sawtooth wire according to claim 1, characterized in that said second back angle of the tooth back from the bend to an imaginary line interconnecting the tooth tips is at least 36°.

5. A cylinder of a fibre-processing machine, comprising a lining made of a sawtooth wire, said sawtooth wire having a tooth base extending in the longitudinal direction of the sawtooth wire and a plurality of teeth arranged one behind the other in the longitudinal direction of said sawtooth wire, each of said teeth having a tooth breast inclined forward at breast angle and a tooth back inclined at a first back angle relative to the longitudinal direction of said sawtooth wire, and configure such that imaginary extensions of the tooth breast and the tooth back intersect and form a tooth tip, characterized in that tooth back defines a second back angle and that the first back angle of the tooth back increases from the tooth base to the tooth tip in such a way that the first back angle in the area of the tooth base is smaller than said second back angle in the area of the tooth tip, the tooth back defining a bend positioned approximately ⅔ of the tooth height, and the breast angle of the tooth being less than 45°.

* * * * *